United States Patent [19]

Gerstine et al.

[11] 4,029,946

[45] June 14, 1977

[54] SPEED CONTROL DEVICE FOR MOVING OBJECTS

[75] Inventors: Milton I. Gerstine, Wilmington, Del.; Setsuo Futatsugi, Kogamigahara; Kazuo Ueda, Kogamigahara; Ryozo Seo, Kogamigahara; Koji Iwasaki, Kogamigahara; Makoto Uemura, Kogamigahara, all of Japan

[73] Assignees: The Boeing Company, Seattle, Wash.; Kawasaki Jukogyo Kabushiki Kaisha, Kobe, Japan

[22] Filed: Nov. 24, 1975

[21] Appl. No.: 634,384

[30] Foreign Application Priority Data

Nov. 22, 1974 Japan ..... 49-134514

[52] U.S. Cl. ..... 235/150.2; 235/150.1; 244/182; 318/591; 318/609

[51] Int. Cl.[2] ..... G06G 7/78

[58] Field of Search ..... 235/150.1, 150.2; 244/182; 318/590, 591, 592, 609

[56] References Cited

UNITED STATES PATENTS

| | | | |
|---|---|---|---|
| 3,633,854 | 1/1972 | Buchholz et al. | 244/182 |
| 3,777,122 | 12/1973 | Borsboom | 235/150.1 |
| 3,819,999 | 6/1974 | Platt | 318/609 |
| 3,906,196 | 9/1975 | Spitz | 235/150.1 |
| 3,946,297 | 3/1976 | Bechtel | 318/609 |

*Primary Examiner*—Jerry Smith
*Attorney, Agent, or Firm*—F. J. Visek; F. J. D'Ambrosio

[57] ABSTRACT

A speed control device for moving objects which can quickly change the speed of said object from one speed to another selected speed without overshooting comprising means for generating a signal representing the difference between the actual speed and the desired speed and adding a constant bias to said difference signal if said signal exceeds a predetermined value so that said biased difference signal will actuate an actuating means to move the object more quickly toward the desired set speed and to use and integrate the unbiased difference signal when said difference signal is below said predetermined value, which integration can be used to send smaller signals to the actuating means as the moving object approaches the desired set speed so as to prevent overshooting.

5 Claims, 4 Drawing Figures

SPEED CONTROL DEVICE FOR MOVING OBJECTS

BACKGROUND OF THE INVENTION

The present invention relates to a speed control device for moving objects. Particularly, the present invention is effective in application to automatic flight control devices for aircraft. However, the present invention is not limited to such applications.

In the conventional automatic flight control devices for aircraft, the aircraft is manually adjusted to the desired altitude, attitude and speed and thereafter the control device is applied for maintaining the manually adjusted altitude, attitude and speed. Among these known automatic flight control devices is one of the type wherein a setting corresponding to the desired flight speed is made and the flight speed of the aircraft is automatically changed to the set speed.

SUMMARY OF THE INVENTION

One object of the present invention is to provide a speed control device which can quickly change the speed not only of aircraft but also of ordinary moving objects from one speed to another set speed without overshooting and can maintain the set speed.

Namely, in the present invention the speed control of an object is performed by the difference signal between an actual speed signal representing the moving speed of the object and a set speed. However, the difference signal becomes smaller as the actual speed approaches the set speed. Therefore, it has in practice been difficult to attain the set speed only by the difference signal. In view of this, the present invention makes it possible to quickly attain the set speed by integrating the difference signal to use it as a control signal when the difference signal is below a predetermined value and by adding a constant bias signal to the difference signal to use the sum signal as a control signal when the difference signal is above the predetermined value.

DESCRIPTION OF THE PREFERRED EMBODIMENTS

The present invention will now be explained with reference to the accompanying drawings.

Figure 1:
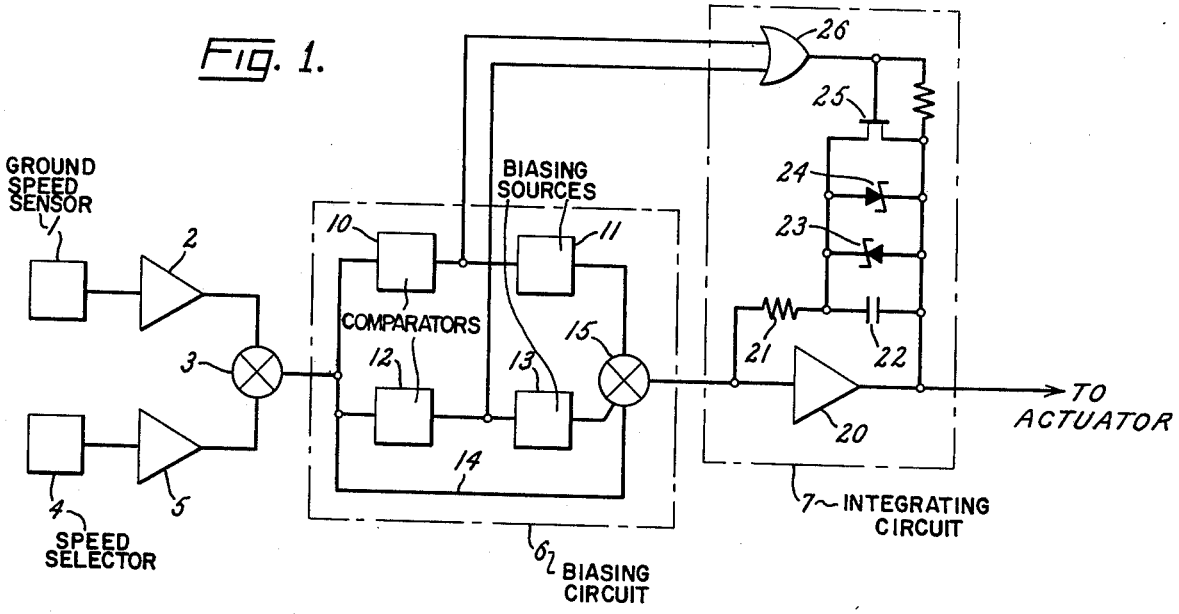
FIG. 1 is a block diagram of one embodiment of the speed control device according to the present invention.

FIG. 1 is a block diagram of a speed control device for a helicopter according to the present invention. The output of a ground speed sensor 1 is amplified by an amplifier 2 and then fed to an adder 3. On the other hand, the output of a speed setter 4 is amplified by an amplifier 5 and fed to the adder 3. This adder 3 adds the two inputs and outputs a signal representing the difference between the actual ground speed and the set speed to a biasing circuit 6. The output of the biasing circuit 6 is fed to a limited integrating circuit 7 having a limited integrating region. The output of the limited integrating circuit 7 is fed to a cyclic pitch actuator for controlling the speed of the helicopter.

Figure 2A:
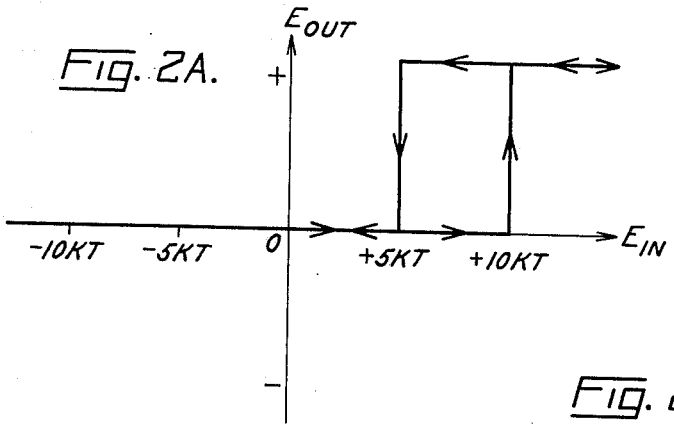
FIGS. 2A and 2B are graphs showing input-to-output characteristics of the comparators in FIG. 1.
Figure 2B:
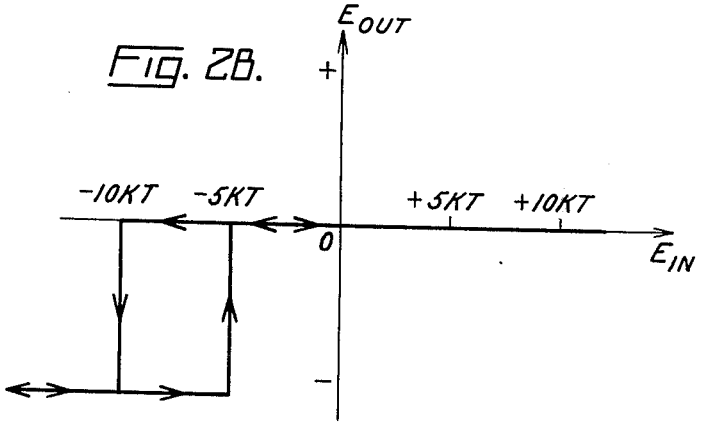

The biasing circuit 6 includes a +10 KT comparator 10, *a* + 10 KT biasing source 11, a −10 KT comparator 12, a −10 KT biasing source 13 and an adding device 15 for adding the output from the two biasing sources to the speed difference signal on a line 14, as shown in FIG. 1. The 10 KT comparators 10 and 12 have input-to-output characteristics, respectively, shown in FIGS. 2A and 2B. More precisely, the +10 KT comparator 10 produces its output when the speed difference signal from the adder 3 increases and exceeds 10 KT, to energize the +10 KT biasing source 11 so that the adder 15 is supplied with a bias signal corresponding to the speed difference of +10 KT. When the speed difference decreases and becomes less than 5 KT, the comparator 10 outputs zero output and the +10 KT bias signal is terminated. Similarly, the −10 KT comparator 12 produces its output, when the speed difference increases and exceeds −10 KT, so as to energize the −10 KT biasing source 13 to apply a bias signal corresponding to the speed difference of −10 KT to the adder 15. As the speed difference decreases and becomes below −5 KT, the −10 KT comparator 12 outputs zero output and the −10 KT bias signal from the −10 KT biasing source 13 to the adder 15 is terminated. Independently of the operation of the comparators and biasing sources, the speed difference signal is fed to the adder 15 through the line 14. Accordingly, in this biasing circuit 6, when the absolute value of the speed difference represented by the speed difference signal from the adder 3 reaches 10 KT, one of the biasing sources 11 and 13 is selected according to the sign of the speed difference to output a bias signal to the adder 15 so that the bias signal is added with the speed difference signal. Because of the operation mentioned above, the speed difference signal which represents a speed difference larger than the actual speed difference by 10 KT in absolute value, is outputted from the adder 15. This condition continues until the absolute value of the speed difference becomes below 5 KT. When the absolute value decreases and becomes 5 KT, the biasing source which is operating is interrupted and the supplying of the bias signal is terminated. As a result, the speed difference signal outputted from the added 3 is outputted as it is from the adder 15. By determining the biasing starting voltage of the speed difference signal higher than the biasing terminating voltage as mentioned above, even if the speed difference signal accidentally becomes larger than the signal corresponding to 5 KT because of noise signal, the bias signal is not totally added. Only when the speed difference is larger than 10 KT is the bias signal added so that the bias signal is maintained without fail until the speed difference decreases and becomes 5 KT. As is apparent from the above, the biasing operation is totally free from the influence of the noise and the like.

The limited integrating circuit 7 which is adapted to receive the output from the biasing circuit 6 comprises an integrator including an amplifier 20, a resistor 21 and a capacitor 22, oppositely directed Zener diodes 23 and 24 which are connected in parallel with the capacitor 22, an FET 25 connected in parallel with the capacitor 22, and an OR circuit 26 having its output connected to a gate electrode of the FET 25 and its inputs connected with the outputs of the comparators 10 and 12.

When there is an output in either of the comparators 10 and 12 of the biasing circuit 6, the limited integrating circuit 7 does not function as an integrator but functions as an amplifier having the amplification degree of 1. Because the output of the comparator is applied to the gate electrode of the FET 25 through the OR circuit 26 to bring the FET in an ON condition whereby the FET in the ON condition short-circuits the capacitor. Furthermore, the limited integrating circuit 7 is so constructed that when the FET 25 is OFF, even if a large speed difference signal is applied to the integrating circuit 7, it has no substantial integrating function. Namely, the integrating circuit utilizes the voltag drops of the diodes 23 and 24 in parallel with the capacitor 22. Particularly, when the output voltage $E_o$ of the integrating circuit is smaller than the voltage drop of the diodes, since the diodes 23 and 24 are substantially neglected, the integrating circuit comes to have the input-to-output characteristics $E_o/Ei$ of the proportion plus integration type. On the other hand, when the output voltage $E_o$ is greater than the voltage drop, the integrating circuit serves as a mere amplifier and therefore has the input-to-output characteristics of the proportion type. For example, when the input voltage $Ei_1$ of the integrating circuit is small the output voltage $E_o$ is of the proportion plus integration type. Namely, at time $t = 0$, the integrating circuit produces its output in proportion to the input thereto. Then, with lapse of the time t, the output voltage $E_o$ becomes larger and finally becomes the magnitude of the proportional output plus the voltage drop of the diode. But, the output voltage does not become larger than that magnitude. Therefore, the integrating circuit outputs a proportional output when the input is large, and has the function of producing an apparent large output when the input is small. As seen from the above, by bringing the FET 25 to OFF (ON) the integrating circuit is caused to have (lose) the function of proportion plus integration. As is apparent from the above, the limited integrating circuit 7 functions as an integrator only when a small input is applied to the integrating circuit with the FET being OFF, and serves as a mere amplifier when the FET is in ON condition because of the biasing operation or when a large input is applied to the integrating circuit even if the FET is OFF. By connecting the FET in parallel with the Zener diodes and connecting the output of the comparators in the biasing circuit to the gate of the FET, the integrating circuit is caused to lose its integrating function when the biasing circuit 6 performs the biasing operation. However, even if the FET 25 and the OR circuit 26 are eliminated from the circuit 7, the circuit 7 sufficiently functions as a limited integrating circuit.

Operation of the speed control device according to the present invention will now be explained. Assuming the case in which the flight speed is changed and increased from 70 KT to 90 KT, first, the speed setter 4 is set to the speed of 90 KT. At this time, the ground speed sensor is detecting an actual speed of 80 KT. Therefore, the adder 3 outputs a speed difference signal, namely, a command signal corresponding to the speed difference of 20 KT. If this command signal is outputted as it is to the actuator, with he decrease of the speed difference the magnitude of the command signal becomes smaller and the operation of the actuator thus becomes gradually smaller. As a result, a very long time is required to reach the set speed. However, in the speed control device according to this invention, the speed difference signal is applied to the biasing circuit 6 where the signal is added with a bias signal corresponding to 10 KT in absolute value, when the speed difference is larger than the predetermined value, for example 5 KT in absolute value (but the biasing starting voltage of the speed difference signal corresponds to 10 KT in absolute value), to obtain a large speed difference signal, i.e., a large command signal for quickly bringing the flight speed to the set speed. Namely, in case of increasing the flight sped from 70 KT to 90 KT, a speed difference signal corresponding to the speed difference of 20 KT is applied to the +10 KT comparator 10 and then the +10 KT comparator 10 energizes the +10 KT biasing source 11 to apply a bias signal corresponding to +10 KT to the adder 15. Accordingly, the adder 15 outputs a speed difference signal corresponding to +30 KT to the limited integrating circuit 7. Since the output of the +10 KT comparator 10 brings the FET 25 on through the OR circuit 26, the integrating circuit 7 loses its integrating function and therefore, the speed difference signal corresponding to +30 KT is applied as it is to the actuator. In this manner, until the speed difference decreases from 20 KT and becomes 5 KT, the speed difference signal added with the bias corresponding to +10 KT, namely, the speed difference signal corresponding to +30 KT – +15 KT, is applied to the actuator. The large speed difference signal thus produced makes it possible to bring the flight speed into the speed difference of less than 5 KT condition in a short time.

When the speed difference decreases and becomes 5 KT, the +10 KT comparator 10 of the biasing circuit 6 outputs zero output and whereby the bias signal corresponding to +10 KT from the +10 KT biasing source is interrupted. Therefore, the speed difference signal representing the speed difference of 5 KT is outputted as it is from the adder 15. When the small speed signal is applied as it is to the actuator, the approach of the flight speed to the set speed takes a long time. However, in the present invention, the small speed differnce signal is applied to the limited integrating circuit 7 where the speed difference signal corresponding to one below 5 KT is integrated to be enlarged and applied to the actuator so that the flight speed is quickly brought to the set speed. Namely, since neither of comparators 10 and 12 in the biasing circuit 6 applies an output, the FET 25 is in OFF condition. Further, since the speed difference signal outputted from the adder 15 is a small signal representing the speed difference less than 5 KT, the function of the integrating circuit 7 is of proportion plus integration type so that an enlarged speed difference signal is applied to the actuator. Since the speed difference signal is enlarged by the integrating circuit as mentioned above, if the speed difference becomes very small, the output signal of the integrating circuit also becomes small. Thus, it is possible to bring the flight speed to the set speed without overshooting or hunting. Further, since the integrating circuit is used, it is possible to elevate the accuracy in the approach to the set speed.

Figure 3:
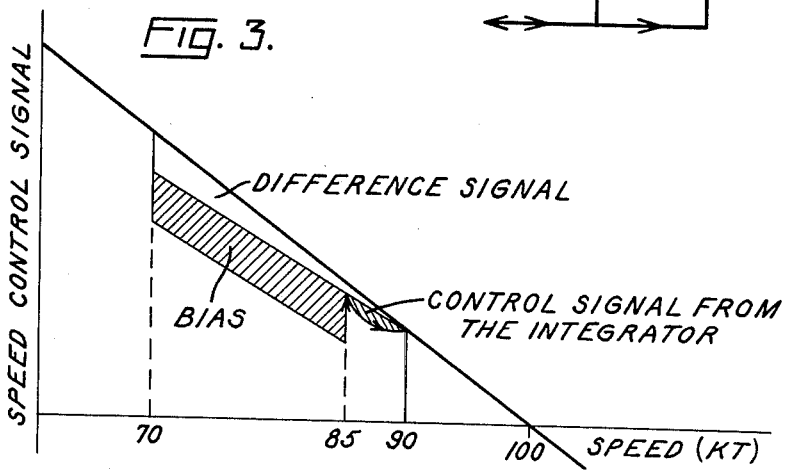
FIG. 3 is a graph showing the operation of the embodiment of FIG. 1.

FIG. 3 is a graph showing how the command signal applied to the actuator changes in the case of increasing the flight speed from 70 KT to 90 KT.

Thus, according to the present invention, in either speed increasing control or speed decreasing control, the actuator is, first, operated by a speed difference signal larger than the actual speed difference and thereafter when the speed difference becomes small the speed difference signal is integrated and the actuator is applied with the integrated signal, whereby the flight speed is quickly brought to the set speed without overshooting or hunting.

As is apparent from the above description to those skilled in the art, the speeds represented by the biasing starting voltage and the biasing terminating voltage of the speed difference signal and the voltage of the bias signal can be suitably changed. Although the speed control device for helicopters has been explained, the speed control device of the present invention can be applied to other moving objects, for example, aircraft, vehicles, and ships.

What is claimed is:

1. A speed control device for moving objects comprising speed detecting means for detecting the actual speed of a moving object and generating a speed signal, speed setting means for generating a set speed signal corresponding to a desired set speed, adding means receiving said actual speed signal and said set speed signal and generating a difference signal corresponding to the difference therebetween, biasing circuit means for adding a bias signal to said difference signal when said difference signal exceeds a predetermined value, resulting thereby in a control signal, and integrating circuit means including means for receiving said control signal and outputting said control signal unaltered, and additional means which together with said means for receiving serve to integrate said difference signal when said difference signal is below said predetermined value, whereby speed control of the moving object is performed by the control signal and the difference signal.

2. The speed control device as defined in claim 1, wherein the biasing circuit means includes comparator means for receiving said difference signal, biasing source means connected to the comparator means and responsive to the output thereof for generating said bias signal, and an adding device for receiving said difference signal and said bias signal and generating said control signal whenever a bias signal is generated, said adding device applying said control signal to said integrating circuit means and said difference signal when the bias signal is zero.

3. The speed control device as defined in claim 2, wherein the comparator means includes a positive output comparator and a negative output comparator, wherein the biasing source means includes a positive output biasing source connected to the positive output comparator and a negative output biasing source connected to the negative output comparator, and wherein said integrating circuit means is connected to the output of both comparators as well as to the adding device.

4. The speed control device as defined in claim 3, wherein each biasing source generates a bias signal when said difference signal exceeds a predetermined value and so long as said difference signal exceeds a further predetermined value, with said further predetermined value being less, in absolute terms, than said predetermined value.

5. The speed control device as defined in claim 1, wherein said means for receiving includes a resistor and capacitor connected in series, and wherein said additional means includes a transistor in parallel with a pair of oppositely directed Zener diodes and the feedback capacitor and an OR circuit connected to the gate electrode of the transistor and to the output of said comparators.

* * * * *